US006786557B2

(12) United States Patent
Montgomery, Jr.

(10) Patent No.: US 6,786,557 B2
(45) Date of Patent: Sep. 7, 2004

(54) PROTECTIVE WEAR SLEEVE HAVING TAPERED LOCK AND RETAINER

(75) Inventor: Robert H. Montgomery, Jr., Everett, PA (US)

(73) Assignee: Kennametal Inc., Latrobe, PA (US)

( * ) Notice: Subject to any disclaimer, the term of this patent is extended or adjusted under 35 U.S.C. 154(b) by 52 days.

(21) Appl. No.: 09/742,796

(22) Filed: Dec. 20, 2000

(65) Prior Publication Data

US 2002/0074851 A1 Jun. 20, 2002

(51) Int. Cl.[7] ..... E21C 35/197
(52) U.S. Cl. ..... 299/104; 299/107; 411/520
(58) Field of Search ..... 299/79.1, 104, 299/107; 403/371, 372; 411/80.5, 516, 520, 528

(56) References Cited

U.S. PATENT DOCUMENTS

| | | | | | |
|---|---|---|---|---|---|
| 3,143,177 | A | * | 8/1964 | Galorneau et al. | 175/413 |
| 3,752,515 | A | | 8/1973 | Oaks et al. | 287/52 |
| 3,767,266 | A | * | 10/1973 | Krekeler | 299/107 |
| 3,833,265 | A | | 9/1974 | Elders | 299/86 |
| 4,057,294 | A | | 11/1977 | Krekeler | 299/93 |
| 4,068,897 | A | | 1/1978 | Amoroso | 299/91 |
| 4,084,856 | A | | 4/1978 | Emmerich et al. | 299/86 |
| 4,299,424 | A | * | 11/1981 | LeBegue et al. | 299/103 |
| 4,337,980 | A | | 7/1982 | Krekeler | 299/91 |
| 4,542,943 | A | | 9/1985 | Montgomery, Jr. | 299/93 |
| 4,582,364 | A | * | 4/1986 | deMey, III | 299/107 |
| 5,088,797 | A | | 2/1992 | O'Neill | 299/91 |
| 5,273,343 | A | | 12/1993 | Ojanen | 299/10 |
| 5,302,005 | A | | 4/1994 | O'Neill | 299/91 |
| 5,303,984 | A | | 4/1994 | Ojanen | 299/86 |
| 5,370,448 | A | | 12/1994 | Sterwerf, Jr. | 299/91 |
| 5,498,069 | A | | 3/1996 | Siebenhofer et al. | 299/81.3 |
| 5,628,549 | A | | 5/1997 | Ritchey et al. | 299/104 |
| 5,725,283 | A | | 3/1998 | O'Neill | 299/104 |
| 5,730,502 | A | | 3/1998 | Montgomery, Jr. | 299/104 |
| 6,059,373 | A | | 5/2000 | Wright et al. | 299/104 |
| 6,086,160 | A | | 7/2000 | Bitelli | 299/104 |
| 6,099,081 | A | * | 8/2000 | Warren et al. | 299/104 |
| 6,176,552 | B1 | * | 1/2001 | Topka et al. | 299/104 |
| 6,247,759 | B1 | | 6/2001 | Montgomery, Jr. et al. | 299/81.3 |
| 6,331,035 | B1 | | 12/2001 | Montgomery, Jr. | 299/106 |

FOREIGN PATENT DOCUMENTS

| | | |
|---|---|---|
| EP | 1033216 | 9/2000 |
| GB | 2182373 | 5/1987 |
| WO | WO 00/43636 | 7/2000 |

OTHER PUBLICATIONS

Kennametal Inc. Advertisement No. B80–71 "Our new C–9 puts you on the road to economical planing." (1980).

* cited by examiner

*Primary Examiner*—John Kreck
(74) *Attorney, Agent, or Firm*—John J. Prizzi

(57) ABSTRACT

A cutting tool assembly including a protective wear sleeve that is fixed in the cavity of a bit holder by a tapered wedge portion that is compressed in a correspondingly tapered portion of the bit holder cavity and an accompanying retainer both combine affix the wear sleeve to the bit holder cavity in a secure manner. The applicant's protective wear sleeve invention can be set in the bit holder by several axial blows with a hammer or other appropriate tool. Unlike some other designs in the prior art which require the insertion of a pin or nut threaded onto a bolt or clip connected to the rear end of the cutting to secure the wear protection sleeve to the bit holder in the invention no other assembly step is necessary to secure the protective sleeve inside the bit holder cavity. The protective sleeve will remain in this position with no relative axial movement or rotation between the wear sleeve and the bit holder during operation of the cutting tool machinery.

19 Claims, 2 Drawing Sheets

PROTECTIVE WEAR SLEEVE HAVING TAPERED LOCK AND RETAINER

FIELD OF THE INVENTION

The invention relates to a manually replaceable protective wear sleeve having a tapered design in combination with a beveled retainer for insertion between the bit holder and cutting tool.

BACKGROUND OF THE INVENTION

For many years the conventional method of attaching cutting bit holder to a drum or chain in the mining and construction industries was to directly weld the bit holding block to the mining or construction machine cutters. This welding method of attachment of cutters to drums and chains required the use of a cutting torch to remove a cutting bit holder, and welding equipment to connect the cutting bit holder to the drum or chain. A skilled welder was needed to remove bit holders and replace the old bit holder with a new bit holder. Because of the difficulties in finding experienced welders and the problems of welding bit holders onto machines on site the bit holders and cutting tools were simply not replaced. This resulted in adjacent bits becoming overloaded and wearing at an accelerated rate. U.S. Pat. Nos. 4,542,943 and 4,068,897 disclose bit holder designs in which the bit holder is removably attached to a support block base typically welded onto the cutting machine to permit easy replacement of the bit holder by unskilled personnel.

In mining machines such as continuous miners, road working machines like road planers and earth moving machines such as mechanized shovels a plurality of cutting bits are mounted on these apparatus for cutting earth strata or man made surfaces such as asphalt, pavement and concrete. Moving means such as a rotating wheels, chains, rotating arms or rotating drums move the bits. Mining machines themselves are of various types including undercutting machines, continuous mining machines and long wall mining machines. The bits generally include bit holders for holding the cutting bits. The bit holder is connected directly to the moving machinery or is connected to a support block that is welded onto the operating machinery. A protective wear sleeve is inserted in the bit holder for reducing the wear on the bit holder caused by fretting between a shank of the cutting bit and a bit holder bore.

The wear sleeves of the prior art are fixed in there proper position in the bit holder by wedge arrangements between the protective wear sleeve and a bit holder bore taught in U.S. Pat. No. 5,498.069 to Siebenhofer et al and U.S. Pat. No. 4,057,294. These wedge arrangements are designed for fixing the protective wear sleeve to the bit holder in such a manner that substantially no relative movement occurs between the protective sleeve and the bit holder. The bit holders in these patents are provided with a tapered portion and the bit holder is provided with a tapered cavity to receive the tapered portion of the wear sleeve. The contact and friction between the protective wear sleeve and the bit holder prevents relative rotation and fretting between the sleeve and bit holder.

The protective wear sleeves of the cutting bit assemblies in industry must be replaced regularly as they wear out. However the protective sleeve must be sufficiently secured in the bit holder so as not to be knocked loose by loads and torques that occur during normal operation of the mining/construction machinery. The prior art protective sleeves in addition to the wedge design include connecting means such as pins, screws, and bolts as taught by U.S. Pat. No. 4,337,980 to Kreckler and U.S. Pat. No. 5,370,448 to Sterwerf.

UK Patent Application 2182373 A, to Alder discloses a cutting tool assembly wear sleeve that is connected to the bit holder by a pin 25 and retainer clip 19 in addition to a tapered wedge.

Cylindrical split ring retainers that are positioned about an annular grooved shank portion of a cutting bit are well-known in the art for securing a wear sleeve to the cavity of a bit holder as seen in U.S. Pat. No. 5,628,549 to Ritchey et al. U.S. Pat. No. 3,833,265 to Elders also shows a split sleeve retainer between the sleeve and bore. The split sleeves is constructed from a resilient spring-like material that is compressed when the split sleeve ring is axially hammered into the cavity of the bit holder. The cylindrical split sleeve becomes biased outwards against the corresponding bit holder cavity bore tightly securing the sleeve against axial movement. The retainer is frictionally held in place against the sidewall of the bit holder bore preventing axial displacement of the retainer. The sidewalls of the annular groove wear sleeve about against the split sleeve retainer and the sleeve is thereby prevented from being axially knocked out of the bit holder. However, such designs sometimes are inadequate since they are somewhat likely to become knocked out during operation of cutting machinery.

U.S. Pat. No. 5,725,283 to O'Neill discloses a wear sleeve that is affixed to the bit holder block by interference fit. The bore dimension of the bit holder and the outer diameter of the wear sleeve have to be precisely cut and honed. There is little tolerance for error in manufacturing the outside diameter of the wear sleeve and the bore of the bit holder. This type of precise manufacturing is expensive and time consuming.

SUMMARY OF THE INVENTION

The protective wear sleeve of the present invention is replaceably mounted in a bit holder so as to prevent relative rotation between the bit holder and protective wear sleeve. The protective wear sleeve of applicant's invention is much less likely than the prior art to be accidentally knocked out by abnormal loads and torques that occur during cutting operations.

The applicant's invention cutting tool assembly includes a protective wear sleeve that is fixed in the cavity of a bit holder by a tapered wedge portion that is compressed in a correspondingly tapered portion of the bit holder cavity and a second retainer fixing means.

The applicant's protective wear sleeve invention can be set in the bit holder by several axial blows with a hammer or other appropriate tool. Unlike some other designs in the prior art which require the insertion of a pin or nut threaded onto a bolt or clip connected to the rear end of the cutting to secure the wear protection sleeve to the bit holder in the invention, no other assembly step is necessary to secure the applicant's protective sleeve inside the bit holder cavity. The protective sleeve will remain in this position with no relative axial movement or rotation between the wear sleeve and the bit holder.

When it is desired to remove the protective wear sleeve form the bit holder the wear sleeve is removed by a prying action using a well-known prying fork that is wedged between a shoulder of the wear sleeve and the exposed mining face of the bit holder. The wear sleeve is easily removed in one prying step without the necessity of disconnecting a retainer, split safety ring or unthreading a bolt for instance as in the prior art.

The split sleeve retainer clip of the present invention includes beveled portions at opposite ends of the cylinder. The beveled ends upon insertion of the retainer into the bit holder cavity bore are compressed into contact with the protective wear sleeve. The angle of taper of the beveled ends decreases from the initial angle of taper of the retainer sleeve in its uncompressed position prior to the protective wear sleeve being inserted into the bit holder The beveled ends of the retainer in its noncompressed unbiased state are initially angled at approximately 25 degrees with respect to the central axis C—C in FIG. 4 of the retainer sleeve, the beveled ends are compressed to an angle between about 12 to 18 degrees when the cutting bit is inserted into the cavity bore of the bit holder.

The beveled ends function, as leaf springs to apply a supplemental restoring force component to the retainer ring. The deflection of the beveled ends occurs within the elastic range limits of the retainer split sleeve material.

Another objective of the applicant's inventions is to design the protective wear sleeve to have an weakened undercut adjacent the top exposed mining face of the bit holder as the preferential failing point of the cutting tool assembly should the cutting tool be subjected to abnormal loads or torques.

This invention discloses an inexpensive way for affixing a protective wear sleeve to a bit holder and in which substantially no relative movement occurs between the protective wear sleeve and the bit holder vastly improving the operable working lives of both the bit holder and protective wear sleeve. This invention is useful in, mining, road planing or earth moving machine.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
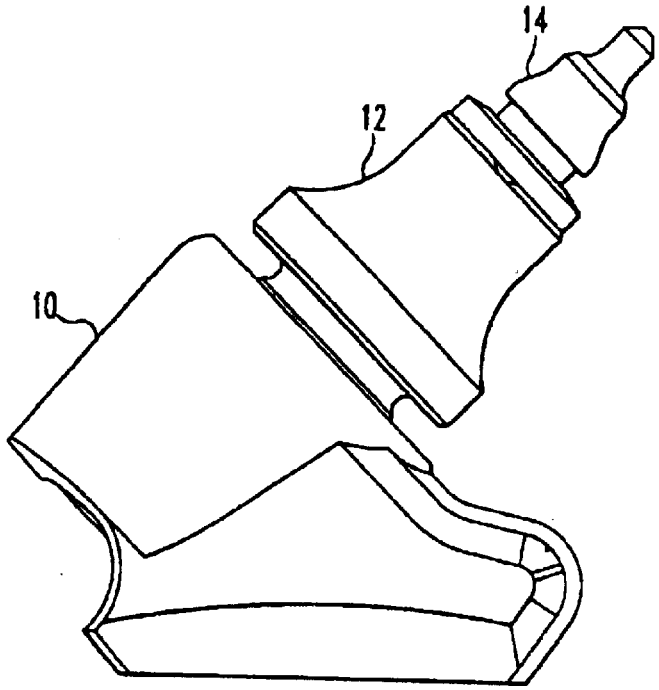
FIG. 1 shows a side view of an embodiment of the invention.

FIG. 1 illustrates the cutting tool assembly of the instant invention. The cutting tool assembly includes a bit holder 10 that has a base that is welded to a rotating drum or a chain. A cutting tool 14 normally having a tip made from cemented tungsten carbide and a protective wear sleeve 12 for protecting the bit holder 10 from wear caused by the rotation, rocking and bobbing of the cutting tool during operation of the mining or construction cutting equipollent.

Figure 2:
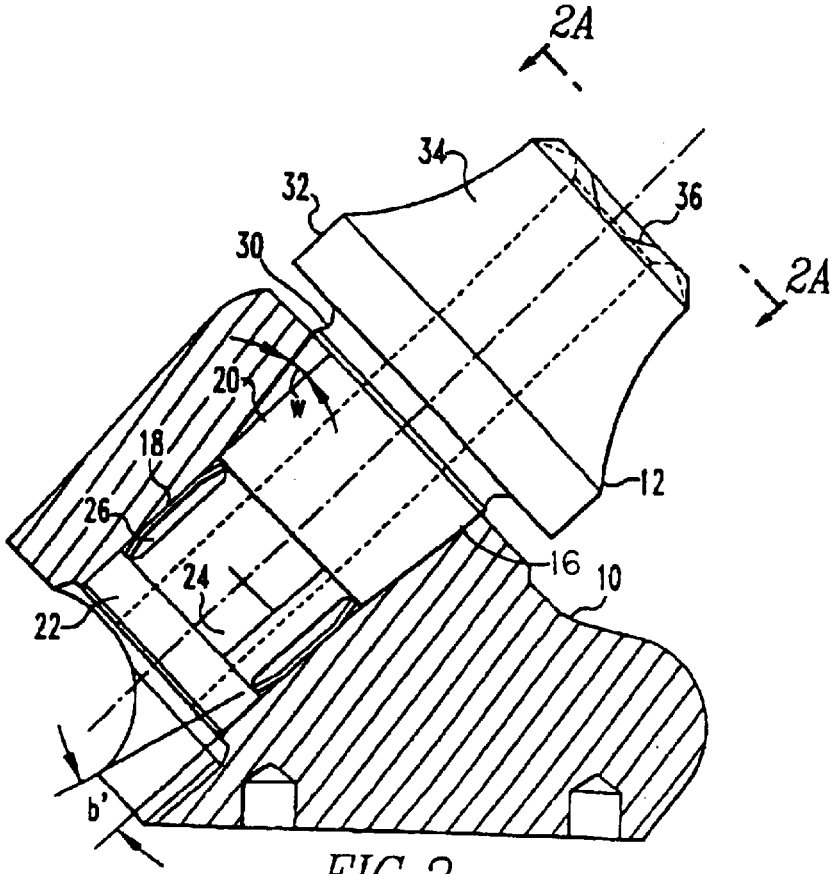
FIG. 2 illustrates a cross-sectional view of the bit holder and protective wear sleeve.
Figure 2A:
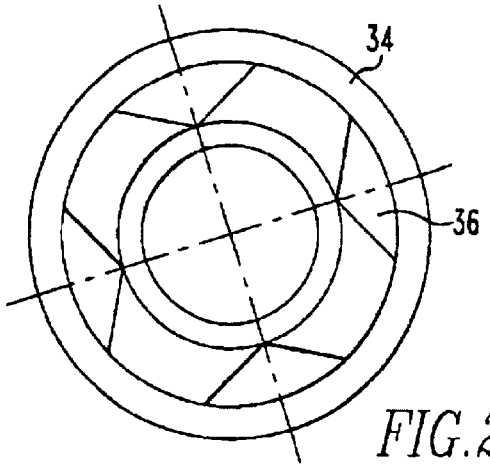
FIG. 2*a* is a view taken along view lines A—A in FIG. 2.

In FIG. 2 the wear sleeve is shown inserted in the receiving cavity of the bit holder. The bit holder block has its forward end adjacent the cutting tool a 5.5–7.0 degree (angle w) tapered cavity bore, and at a rearward end of the bit holder cavity bore a cylindrical section adapted to be received in a manufactured rearward disc end portion 22 of the wear sleeve, the cylindrical section reduces fish-tailing. The wear sleeve has a complimentary tapered forward end portion 20 that is adapted to be received in the tapered forward end portion of the cavity bore 16.

The wear sleeve has an external portion 34 that extends outwardly beyond the front face of the bit holder block. The other portion of the wear sleeve is adapted to be received in the bit holder. This portion includes the forward tapered portion 20, groove section 24, retainer 26 and rearward disc end portion 22 which fit into the bit holder 10 cavity bore. This external portion of the wear sleeve includes a shoulder 32 for grasping, leveraging and prying against in order to remove the wear sleeve.

Figure 4:
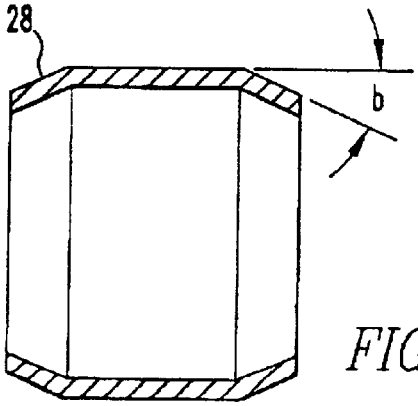
FIG. 4 illustrates a cross-section along the axial length of the retainer.

Between the forward tapered end of the protective wear sleeve and the rearward end of protective wear sleeve is stepped diameter annular groove section 24 adapted to receive a split retainer 26. In FIG. 2 the retainer 26 is illustrated as being attached to the wear sleeve about the annular groove portion 24. The embodiment in FIG. 4 shows the retainer in more detail including a central cylindrical section and two beveled portions at each end 28. As seen in FIG. 4 in the uncompressed state the beveled ends are angled b degrees from the central axis of the retainer. The angle b is between 22–28 degrees and preferably 25 degrees. When the wear sleeve is fit into the bit holder the beveled ends of the retainer are radially compressed inward by the sidewall of the bit holder cavity bore. The beveled ends are compressed to an angle (b' in FIG. 2) between about 12 to about 18 degrees when the cutting bit is inserted into the cavity bore of the bit holder. The beveled ends function as leaf springs to apply a supplemental restoring force component in comparison to the restoring force of a conventional straight end cylindrical split sleeve retainer. The deflection of the beveled ends occurs within the elastic range limits of the retainer material.

Figure 3:
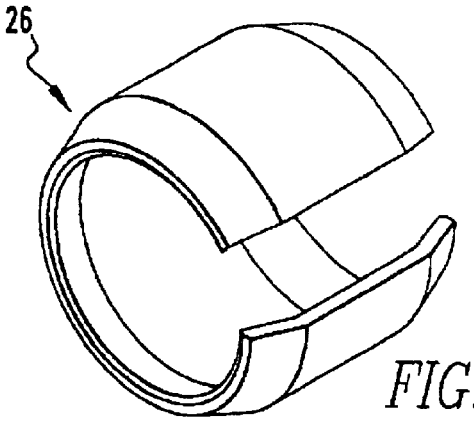
FIG. 3 illustrates a perspective view of the retainer.

In one specific design of the embodiment according to FIG. 2 the wear sleeve shank at the annular groove portion has a diameter of 1.260" (inches), the rearward disc end portion 22 and the smallest inward diameter of the tapered frusto-conical portion 20 both have diameters of 1.505". Rounded fillets at both ends of the annular groove form the transition from between the smaller annular groove diameter 1.260" to the larger 1.505" diameters at the groove ends. The fillets have a radius of curvature of approximately 0.08". The rearward portion 18 of the cavity bore has a diameter of approximately 1.55". The axial length of the annular groove portion 22 of the wear sleeve is 1.030" and the generally cylindrical retainer 26 that surrounds the shank in this annular portion has an axial length of 0.95". The width of the retainer's axial slot illustrated in FIG. 3 is 0.56". The retainer is made from 1050 SPRING STEEL, the sheet steel having a thickness of between 0.058"–0.062". When the wear sleeve assembly (i.e. shank and retainer) is hammered into the support block the retainer is compressed and the beveled ends 28 contact the wear sleeve at the rounded fillet transition sections and are deflected from about an initial 25 degrees before being hammered into the bit holder to approximately 15 degrees when the wear sleeve is inserted and the retainer compressed.

The relationship of the combination of frictional forces between the tapered portions of the wear sleeve and the tapered portion of the bit holder along with the retention force of the beveled split retainer adequately prevent undesirable rotation and fretting between the wear sleeve and bit holder. The angle of taper between the mutual forward section of the wear sleeve and bit holder cavity bore is such that these two contact surfaces will not wedge and lock together. The resilient retainer similarly is a releasable design. With applicant's invention it is possible to replace the wear sleeve quickly in one manual-prying step. This simple one step method enables the wear sleeve to be replaced on site such as during underground mining, reducing the time that the cutting machinery is out of service.

The shoulder 32 is axially spaced from the forward tapered portion 20 of the wear sleeve. Between the forward tapered portion 20 of the wear sleeve and shoulder 32 is a rounded undercut section 30. The undercut section 30 forms a preferential fail point on the wear sleeve whenever the cutting tool is subjected to abnormally high operating loads. The failure of the wear sleeve at the undercut prevents an expensive bit holder from failing (breaking) or being knocked off the drum. Replacement of blocks is more expensive than replacing wear sleeves and welding of blocks back onto a drum, for instance, is more time consuming than hammering a replacement wear sleeve into place.

The forward most end of the protective wear sleeve has a plurality of notches 36 to allow an appropriate prying tool to be easily inserted between the cutting tool 14 shoulder (or wear washer on some prior art cutting tool assembly designs) and the wear sleeve 12. The prying tool is readily inserted into the notch and manually rotated and pivoted to disengage the cutting tool 14 from the protective wear sleeve 12.

The wear sleeve can be removed by inserting a prying tool between the top face of the bit holder and the wear sleeve shoulder.

What is claimed is:

1. An apparatus for mounting a cutting tool used in mining, road working or earth moving comprising: a bit holder, a protective wear sleeve for reducing wear between the cutting tool and said bit holder, said protective wear sleeve having an external portion and a portion that is adapted to being received in said bit holder, said wear sleeve portion that is adapted to be received, including a rearward disc end portion, an annular groove portion and a forward tapered portion, and a retainer, wherein when said wear sleeve is hammered into position inside said bit holder, said retainer is biased outwards against said bit holder, whereby once said protective wear sleeve is set in said bit holder by axial blows with a hammer, said protective wear sleeve will remain in said bit holder without relative rotational or axial movement between said protective wear sleeve and said bit holder.

2. The apparatus according to claim 1 wherein said forward tapered portion is tapered at an angle of between 5.5–7.0 degrees from a central axis of the wear sleeve.

3. The apparatus according to claim 2 wherein said retainer is positioned around said annular groove of the wear sleeve.

4. The apparatus of claim 2 wherein said bit holder includes a cavity bore having a forward tapered portion and a rearward cylindrical portion for cooperatively receiving said wear sleeve.

5. The apparatus of claim 4 wherein said forward tapered portion of the bore is tapered at an angle of between 5.5–7.0 degrees from a central axis of the cavity bore.

6. The apparatus according to claim 1 wherein the external portion is adjacent to the forward tapered portion, said wear sleeve external portion has a shoulder and a rounded undercut portion between said shoulder and said forward tapered portion of said wear sleeve, whereby when said wear sleeve is subjected to large loads and torques, the rounded undercut portion weakens and fails first.

7. The apparatus according to claim 1 wherein said retainer is generally a cylindrical split sleeve retainer having beveled portions at both ends of said cylindrical retainer, whereby said beveled end portions compress when inserted into said bit holder, said beveled ends help bias said cylindrical split sleeve outwardly away form said wear sleeve.

8. The apparatus according to claim 7 wherein said retainer beveled portions are initially angled at 25 degrees with respect to the central axis of said cylindrical retainer.

9. A joint coupling comprising:

a female member, a male member, said male member having an external portion and a portion that is adapted to being received in said female member, said male member portion that is adapted to be received including a rearward disc end portion, an annular groove portion, a forward tapered portion and a retainer, wherein when said male member is hammered into position inside said female member, said retainer is biased outwards against said female member, whereby once said male member is set in said female member, said male member will remain in said female member without relative rotational or axial movement between said male member and said female member.

10. The joint coupling according to claim 9 wherein said retainer is positioned around said annular groove of the male member.

11. The apparatus to claim 10 wherein said retainer is generally a cylindrical split sleeve retainer having beveled portions at both ends of said cylindrical retainer, whereby said beveled end portions compress when inserted into said female member, said beveled ends help bias said cylindrical split sleeve outwardly away from said male member.

12. The joint coupling according to claim 11 wherein said retainer beveled portions are initially angled at 25 degrees with respect to the central axis of said cylindrical retainer.

13. The joint coupling according to claim 9 wherein said female member includes a cavity bore having a forward tapered portion and a rearward cylindrical portion for cooperatively receiving said male member.

14. The joint coupling according to claim 9 wherein the external portion is adjacent to the forward tapered portion, said male member external portion has a shoulder and a rounded undercut portion between said shoulder and said forward tapered portion of said male member, whereby when said male member is subjected to large loads and torques the rounded undercut portion weakens and fails first.

15. A cutting tool assembly comprising:

a bit holder, a protective wear sleeve for reducing wear between the cutting tool and said bit holder, said protective wear sleeve having an external portion and a portion that is adapted to being received in said bit holder, said wear sleeve portion that is adapted to be received including a rearward disc end portion, an annular groove portion, a forward tapered portion and a retainer, wherein when said wear sleeve is hammered into position inside said bit holder, said retainer is biased outwards against said bit holder, whereby once said protective wear sleeve is set in said bit holder by axial blows with a hammer, said protective wear sleeve will remain in said bit holder without relative rotational or axial movement between said protective wear sleeve and said bit holder.

16. An apparatus for mounting a cutting tool used in mining, road working or earth moving comprising:

a bit holder including a cavity bore having a rearward cylindrical portion, a protective wear sleeve for reducing wear between the cutting tool and said bit holder, said protective wear sleeve having a portion that is adapted to being received in said bit holder, said wear sleeve portion that is adapted to be received including a rearward disc end portion, an annular groove portion, a forward tapered portion and a retainer, wherein when said protective wear sleeve is hammered into position inside said bit holder, said retainer is biased outwards against said rearward cylindrical portion, whereby once said protective wear sleeve is set in said bit holder by axial blows with a hammer, said protective wear sleeve will remain in said bit holder without relative rotational or axial movement between said protective wear sleeve and said bit holder.

17. The apparatus according to claim 16 wherein said wear sleeve further comprises an external portion having a shoulder.

18. An apparatus for mounting a cutting tool used in mining, road working or earth moving comprising:

a bit holder including a cavity bore having a forward tapered portion and a rearward cylindrical portion, a protective wear sleeve for reducing wear between the cutting tool and said bit holder, said protective wear sleeve having a portion that is adapted to being received in said bit holder, said wear sleeve portion that is adapted to be received including a rearward disc end portion, an annular groove portion, a retainer and a forward tapered portion, wherein when said protective wear sleeve is hammered into position inside said bit holder, said retainer is biased outwards against said rearward cylindrical portion, whereby once said protective wear sleeve is set in said bit holder by axial blows with a hammer, said protective wear sleeve will remain in said bit holder without relative rotational or axial movement between said protective wear sleeve and said bit holder.

19. The apparatus according to claim 18 wherein the wear sleeve has an external portion adjacent to the forward tapered portion, said wear sleeve external portion has a shoulder and a rounded undercut portion between said shoulder and said forward tapered portion of said wear sleeve, whereby when said wear sleeve is subjected to large loads and torques, the rounded undercut portion weakens and fails first.

* * * * *